United States Patent [19]

Shinagawa et al.

[11] 4,366,239

[45] Dec. 28, 1982

[54] POLYESTER BASE DRAFTING FILM WITH NITROCELLULOSE AND POLYMETHYLMETHACRYLATE LAYER

[75] Inventors: Yukio Shinagawa; Sumio Ohtani; Koichi Suematsu; Hideo Kawaguchi, all of Minami-ashigara, Japan

[73] Assignee: Fuji Photo Film Co., Ltd., Kanagawa, Japan

[21] Appl. No.: 339,799

[22] Filed: Jan. 15, 1982

Related U.S. Application Data

[63] Continuation of Ser. No. 195,272, Oct. 8, 1980, abandoned.

[30] Foreign Application Priority Data

Oct. 8, 1979 [JP] Japan ..... 54/129774

[51] Int. Cl.[3] ..... G03C 1/78

[52] U.S. Cl. ..... 430/533; 430/534; 430/535; 428/481; 428/483

[58] Field of Search ..... 428/481, 483; 430/531, 430/533, 534, 535

[56] References Cited

U.S. PATENT DOCUMENTS

| | | | |
|---|---|---|---|
| 3,161,519 | 12/1964 | Alsup | 430/950 |
| 3,353,958 | 11/1967 | Moede | 430/535 |
| 3,516,832 | 6/1970 | Earhart et al. | 430/950 |
| 4,100,329 | 7/1978 | Neithardt | 430/950 |

*Primary Examiner*—Jack P. Brammer

*Attorney, Agent, or Firm*—Sughrue, Mion, Zinn, Macpeak & Seas

[57] ABSTRACT

A drafting film comprising a hydrophobic support and a matte layer formed thereon, said matte layer comprising silicon dioxide as a matting agent and a mixture of polymethyl methacrylate or a copolymer thereof and nitrocellulose. The drafting film show excellent adaptability for writing or drawing and revising or erasing.

A wash-off type photographic film is also provided by forming a wash-off silver halide photosensitive emulsion layer on the drafting film.

12 Claims, No Drawings

POLYESTER BASE DRAFTING FILM WITH NITROCELLULOSE AND POLYMETHYLMETHACRYLATE LAYER

This is a Continuation, of application Ser. No. 195,272, filed Oct. 8, 1980, now abandoned.

BACKGROUND OF THE INVENTION

1. Field of the Invention

This invention relates to a matte film of the type that lines, characters, etc., can be drawn or written thereon and which can be revised or erased (hereinafter, the film is referred to as a drafting film). More particularly, the invention relates to a drafting film comprising a hydrophobic support having coated on one or both surfaces thereof matte layers wherein lines, characters, etc., can be directly drawn or written on the matte layer and easily revised or erased or further reproductions composed of wash-off relief images formed on the matte layer can be easily revised or erased by an eraser. Furthermore, the invention relates to a wash-off type photographic material using the above-described drafting film as the support.

2. Description of the Prior Art

A matte film generally comprises a low shrink hydrophobic support having formed thereon a matte layer containing a matting agent such as silicon dioxide, titanium dioxide, a glass powder, etc. Such a matte film can be used as it is for drawing or can be used as a support for a wash-off type photographic film comprising a photosensitive silver halide emulsion layer on the matte layer, which is used in such a manner that after imagewise exposing and developing the photographic film, non-image portions are washed off from the matte layer.

A matte film is required to have various properties for satisfactory use thereof, among which the following two properties are most important.

(1) The film must have excellent tensile strength, tear resistance, and bending strength, and undergo low curing and low dimensional deformation under the influence of temperature and/or humidity.

(2) The film must have good adaptability for drawing or writing with a drawing ink, pencil, etc., and also show good erasability at the case of erasing with an eraser, etc., after drawing or writing.

This invention is pertinent particularly to an improvement of the adaptability for drawing or writing and for revising or erasing as per property (2) above.

As binders for conventional matte layers of matte films, there are known vinylidene chloride copolymers (e.g., British Pat. No. 1,047,697), polymethyl methacrylate (e.g., U.S. Pat. No. 3,353,958), polyesters or polyester amide (e.g., U.S. Pat. No. 3,627,563, cellulose acetate (e.g., Japanese Patent Publication No. 48844/74), cellulose esters and polyesters (e.g., Japanese Patent Publication No. 39414/74), etc. However, in the case of using matte layers composed of binders as described above, it frequently happens that when lines or characters drawn or written with a pencil are erased with an eraser, dark traces of pencil writing remain on the matte layers to make erasing imperfect or, when the erasing force with an eraser is increased, the matte layers are scraped off.

SUMMARY OF THE INVENTION

An object of this invention is to provide a drafting film having an improved matte layer capable of repeated drawing or writing and revising or erasing more than 10 times.

According to this invention, a drafting film which can be repeatedly used for drawing or writing and revising or erasing is obtained by using a mixture of (i) polymethyl methacrylate or a copolymer thereof containing at least 80% by weight methyl methacrylate and (ii) nitrocellulose as the binder for the matte layer thereof.

Thus, the invention provides a drafting film comprising a hydrophobic support having a matte layer containing silicon dioxide as the matting agent, said matte layer containing a mixture of (i) polymethyl methacrylate or a copolymer thereof and (ii) nitrocellulose as a binder.

DETAILED DESCRIPTION OF THE INVENTION

Examples of the methyl methacrylate copolymer used in this invention are copolymers of methyl methacrylate and vinyl compounds such as methyl acrylate, ethyl acrylate, butyl acrylate, styrene, methyl styrene, chlorostyrene, vinyl acetate, vinyl chloride, vinylidene chloride, acrylic acid, acrylonitrile, glycidyl acrylate, glycidyl methacrylate, hydroxyethyl acrylate, and the like.

Polymethyl methacrylate and a methyl methacrylate copolymer used in this invention have a molecular weight (viscosity-average molecular weight) of ranging from about 10,000 to about 500,000, preferably from 100,000 to 300,000.

The mixing ratio of polymethyl methacrylate or a methyl methacrylate copolymer and nitrocellulose is preferably 50–5% by weight, particularly 40–10% by weight of nitrocellulose based on total weight of the weight of polymethyl methacrylate or copolymer thereof and the weight of the nitrocellulose.

In this invention, while silicon dioxide is used as the matting agent, the silicon dioxide may be used together with titanium dioxide, zinc oxide, starch, barium sulfate, etc. As the silicon dioxide, crystalline silica is preferably used in this invention and such a silica is commercially available under the trade name of, for example, Crystalite-FM-1, or Crystalite-VXR (made by Takimori K.K.).

When matting agents other than silicon dioxide are used together with silicon dioxide, an amount of the matting agents other than silicon dioxide is about 10% by weight or less based on the weight of silicon dioxide and also about 5% by weight or less based on total weight of all solid contents to be coated.

There is no particular restriction on the size of the matting agent but it is preferred that the mean particle size of the matting agent be 0.5 to 10 microns, particularly 1 to 5 microns.

As the hydrophobic support use in this invention, there can be used polyester films such as polyethylene terephthalate films, polyethylene naphthalate films, etc.; cellulose ester films such as cellulose acetate films, cellulose acetate butyrate films, etc.; and polycarbonate films. Polyester films having good dimensional stability are preferably used in this invention.

The matte layer may be formed on the hydrophobic support by dissolving the binder in a solvent, dispersing the matting agent in the resulting solution using an attriter, sand grinder, homogenizer, ball mill, etc., and then coating the support with the dispersion. Examples of the solvent used include ketones such as acetone, methyl ethyl ketone, cyclohexanone, etc.; esters such as ethyl acetate, propyl acetate, butyl acetate, etc.; ethers such as dioxane, tetrahydrofuran, etc.; alcohols such as methanol, ethanol, propanol, butanol, diacetone alcohol, etc.; chlorinated hydrocarbons such as methylene chloride, ethylene chloride, propylene chloride, etc.; phenols such as phenol, cresol, resorcin, etc.; and methyl cellosolve, ethyl cellosolve, methyl cellosolve acetate, dimethylformamide, etc. They may be used solely or as a mixture of two or more.

The solvent is used in an amount of about 50 to 90% by weight based on the weight of the coating solution.

The matte layer in this invention may further contain a coating aid, a cross-linking agent, a whitening agent, etc. As the whitening agent used in the matte layer, titanium dioxide (0.1 to 0.5 micron) is preferred. The coverage of titanium dioxide is preferably 0.03 to 3 $g/m^2$, particularly 0.05 to 2 $g/m^2$, in the matte layer.

The matte layer may be formed directly on the support or may be formed on a subbing layer previously coated on the support.

The subbing layer can be formed by coating the support with a cellulose ester such as nitrocellulose, cellulose diacetate, etc., a polyester, a styrene-butadiene copolymer, or a vinylidene chloride copolymer solely or as a combination thereof as a binder using an organic solvent such as methanol, acetone, methyl ethyl ketone, etc.

If desired, the subbing layer may contain a swelling agent for the polyester film support, e.g., polyethylene terephthalate, such as cresol, p-chlorophenol, resorcin, etc.

The matte layer can be coated using an ordinary coating system such as gravure coating, extrusion coating, dip coating, bar coating, roller coating, bead coating, etc., as can be the subbing layer.

The matte layer thus-coated is preferably dried at 50° to 140° C. for from 30 seconds to 10 minutes.

It is preferred that the coverage (dry coverage) for the matte layer be 1 to 20 $g/m^2$, particularly 3 to 10 $g/m^2$, for the matting agent, 1 to 10 $g/m^2$, particularly 2 to 5 $g/m^2$, for polymethyl methacrylate or a copolymer thereof, and 0.5 to 10 $g/m^2$, particularly 1 to 5 $g/m^2$, for nitrocellulose.

The case of using the matte film or drafting film of this invention as a support for a wash-off photographic material will be described below.

The main feature of a wash-off photographic material is that since only image portions (i.e., exposed portions) of the photosensitive silver halide emulsion layer are hardened at development and non-image portions (i.e., unexposed portions) are not hardened at development, the non-image portions can be removed by running water after development, leaving the image portions as a relief image.

Therefore, it is a most important feature for a wash-off photographic material to use a hardening type developing agent which hardens only developed portions (hereinafter referred to as a tanning development agent). The tanning developing agent may be incorporated in the photograhic material or a processing solution.

Practical examples of the tanning developing agents are catechol, 4-phenylcatechol, hydroquinone, pyrogallol, dihydroxybiphenyl, polyhydroxyspirobisindan, etc. Furthermore, U.S. Pat. Nos. 2,592,368, 2,685,510, 3,143,414, 2,751,295 and 3,440,049 describe tanning developing agents useful herein.

In the case of incorporating, the tanning developing agent in a photographic material, it is preferred that the amount of the tanning developing agent be 0.005 to 1 mol, particularly 0.01 to 0.3 mol, per mol of silver halide in the photosensitive silver halide emulsion layer. The tanning developing agent may be incorporated not only in a photosensitive silver halide emulsion layer but also in a layer adjacent to the photosensitive silver halide emulsion layer.

As methods of incorporating the tanning developing agent in photographic materials, an alkali solution of the compound can be neutralized as described in U.S. Pat. No. 3,440,049; the tanning developing agent can be dispersed in a silver halide emulsion as a solution in a water-soluble organic solvent such as cyclohexane, acetone, methoxyethanol, ethoxyethanol, etylene glycol, dioxane, dimethylformamide, etc.; the tanning developing agent can be dispersed in a silver halide emulsion as a solution in a high-boiling organic solvent for coupler dispersing, such as butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate, trioctadecyl phosphate, etc., as described in U.S. Pat. No. 3,676,137, or in diethyl succinate, dioctyl adipate, 3-ethylbiphenyl, etc. Furthermore, in the case of dispersing the solution of the tanning developing agent in the aforesaid solvent in a hydrophilic protective colloid solution, a surface active agent is usually used and as such a surface active agent, saponin, sodium alkylsulfosuccinate, sodium alkylbenzenesulfonate, etc., may be used.

The wash-off photographic material of this invention has a photosensitive silver halide emulsion layer on the matte film or drafting film of this invention and, if desired, the photographic material further can have an antihalation layer, a surface protective layer, etc.

As the silver halide for the silver halide emulsion used for the wash-off photographic material of this invention, there can be used conventional silver chloride, silver chlorobromide, silver bromide, silver iodobromide, silver iodochlorobromide, etc.

Examples of the hydrophilic protective colloid used in this invention to protect the silver halide are gelatin, carboxymethyl cellulose, polyvinyl alcohol, polyvinyl pyrrolidone, etc. Among these materials, gelatin is most preferred and as the gelatin, lime-processed gelatin, acid-processed gelatin, enzyme-processed gelatin, and gelatin derivatives can be used.

The silver halide emulsion layer may further contain an anti-foggant, a polymer latex, a surface active agent, a chemical sensitizer, a spectral sensitizing dye, etc., as described in *Research Disclosure,* Vol. 176, pages 22–29 (December, 1978).

At present, a surface protective layer may contain a matting agent, a surface active agent, a polymer latex, a colloidal silica, etc., in addition to a hydrophilic protective colloid.

It is preferred in the wash-off photographic material of this invention to form an antihalation layer between the matte film as the support and the photosensitive silver halide emulsion layer. The antihalation layer may further contain carbon black, colloidal silver, and other additives as described in the above *Research Disclosure* as a light absorbing material in addition to the hydrophilic protective colloid but particularly, carbon black or colloidal silver is preferred.

The antihalation layer is preferably in a dry thickness of about 0.05 to about 1.45 microns, particularly 0.2 to 0.9 micron.

For forming a hydrophilic colloid layer such as silver halide emulsion layer, antihalation layer, etc., on the matte film, a gelatin subbing layer mainly composed of gelatin may be formed on the surface of the matte layer.

There is no particular restriction on the development method for the wash-off photographic material of this invention. For example, when the wash-off photographic material of this invention contains a tanning developing agent, the photographic material may be processed in an activator bath.

The activator bath is fundamentally a general black-and-white developer containing, however, no developing agent, as described in U.S. Pat. Nos. 2,592,368, 2,685,510, 3,143,414, 2,751,295 and 3,440,049; the activator bath may contain a pH buffer, an anti-foggant, a development accelerator, a water softener, etc.

The invention will now be further explained by the following examples; the invention is not in any way limited thereby.

EXAMPLE 1

A biaxially-oriented polyethylene terephthalate film of 100μ0 thick was coated with the following liquid composition for forming a subbing layer at 15 g/m$^2$ (wet coating weight) and dried at 120° C. for 10 minutes.

| | % by weight |
|---|---|
| Nitrocellulose, RS ½ (trade name, made by Daicel Ltd.) | 0.5 |
| Meta-creseol | 8 |
| Acetone | 42 |
| Methanol | 49.5 |

The layer thus-formed was then coated with matting agent dispersion (a) or (b) having the following composition at 40 g/m$^2$ (wet coating weight) and dried at 120° C. for 5 minutes to provide sample (A) or (B), respectively.

| | Matting Agent Dispersion: | % by weight |
|---|---|---|
| (a) | Polyvinylidene chloride Saran Resin X-202 (trade name, made by Asahi Dow Co.) | 8 |
| | Methyl ethyl ketone | 49 |
| | Tetrahydrofuran | 25 |
| | Acetone | 10 |
| | Silicon dioxide (mean particle size of 1.5μ) | 7 |
| | Titanium dioxide (mean particle size of 0.3μ) | 1 |
| (b) | Polymethyl methacrylate, Sumipex B-LG (trade name, made by Sumitomo Chemical Co., Ltd.; mean molecular weight of about 100,000) | 8 |
| | Nitrocellulose, RS ½ (trade name, made by Daicel Ltd.) | 3 |
| | Methyl ethyl ketone | 46 |
| | Acetone | 25 |
| | Diacetone alcohol | 10 |
| | Silicon dioxide (mean particle size of 1.5μ) | 7 |
| | Titanium dioxide (mean particle size of 0.3μ) | 1 |

Writing with a 6H pencil and erasing with a drawing eraser was repeatedly applied to the matted surface of each of samples (A) and (B). The results showed that in case of sample (A) traces of pencil writing were incompletely erased and remained as dark traces after writing and erasing were repeated three times. In case of sample (B), pencil writing traces were completely erased even when writing and erasure were practiced 15 times.

EXAMPLE 2

(i) Preparation of Support

A biaxially-oriented polyethylene terephthalate film of 100μ thick was coated with the following coating solution having the following composition for forming a subbing layer at 10 g/m$^2$ (wet coating weight) and dried at 120° C. for 5 minutes.

| | % by weight |
|---|---|
| Cellulose diacetate | 0.4 |
| Nitrocellulose, RS ½ (trade name, made by Daicel Ltd.) | 0.4 |
| Acetone | 50 |
| Resorcin | 6.2 |
| Methanol | 43 |

Then, a matting agent dispersion having the following composition was coated at 50 g/m$^2$ (wet coating weight) and dried at 120° C. for 10 minutes.

| | % by weight |
|---|---|
| Polymethyl methacrylate, Sumipex B-LG (trade name, made by Sumitomo Chemical Co., Ltd.; mean molecular weight of about 100,000) | 9 |
| Diacetone alcohol | 15 |
| Acetone | 50 |
| Methanol | 11 |
| Nitrocellulose, RS ½ (trade name, made by Daicel Ltd.) | 2.5 |
| Silicon dioxide (mean particle size of 1.5μ) | 12 |
| Titanium dioxide (mean particle size of 0.3μ) | 0.5 |

The matte layer thus-formed was further coated with a solution having the following composition at 10 g/m$^2$ (wet coating weight) and dried at 120° C. for 10 minutes.

| | % by weight |
|---|---|
| Gelatin | 1 |
| Polyamidoepichlorohydrin resin as described in U.S. Pat. No. 3,915,711 (i.e., Additive 1 at column 2, line 65 of said patent) | 0.02 |
| Nitrocellulose, RS ½ (trade name, made by Daicel Ltd.) | 0.5 |
| Water | 2 |
| Acetic acid | 2 |
| Methanol | 63.48 |
| Acetone | 30 |

(ii) Preparation of Wash-Off Photographic Material

A silver halide emulsion containing 60 g of gelatin and 1.1 mols of silver chlorobromide (30 mol% silver bromide) in 760 g of water was prepared. The mean grain size of the silver chlorobromide was 0.4 micron. After removing soluble salts from the emulsion in a conventional manner, the silver halide emulsion was chemically sensitized by adding 0.005 g of sodium thiosulfate. To the silver halide emulsion were added 20 g of an aqueous 6% by weight saponin solution and 500 g of dispersion (a) prepared by the following manner.

Dipsersion (a) was prepared by vigorously stirring a mixture of composition (a-1) and composition (a-2) having the following compositions:

| | |
|---|---|
| Composition (a-1): | |
| 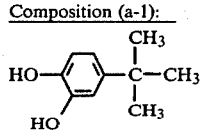 | 17 g |
| 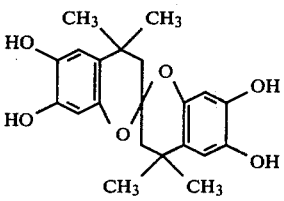 | 3 g |
| 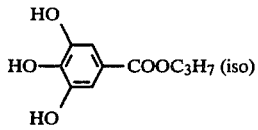 | 7 g |
| Tricresyl phosphate | 18 g |
| Ethyl acetate | 25 g |
| Composition (a-2): | |
| Gelatin | 25 g |
| Water | 380 g |
| Aqueous 6% by weight saponin solution | 25 g |

Further, a coating solution for forming an antihalation layer having the following composition was prepared.

| | |
|---|---|
| Gelatin | 40 g |
| Carbon black | 15 g |
| Water | 1 l |

The coating composition for the antihalation layer described above was coated on the support prepared in step (i) at a carbon black coverage of 0.1 g/m$^2$ and then the silver halide emulsion prepared above was coated on the layer at a silver coverage of 3 g/m$^2$ to provide a wash-off photographic material.

The sample was exposed for 5 seconds through an optical wedge, developed in an activator processing solution having the following composition for 10 seconds at 20° C., unhardened portions were wiped off with a sponge in warm water of 40° C., and then the sample was dried.

| Activator Composition: | |
|---|---|
| Potassium carbonate | 25 g |
| Potassium hydroxide | 7 g |
| Potassium sulfite | 1 g |
| Potassium bromide | 0.1 g |
| Water to make | 1 l |

Writing with pencil and erasing with an eraser were repeated 15 times on the uncovered matte surface at non-image areas; no pencil traces remained on the matte surface.

While the invention has been described in detail and with reference to specific embodiments thereof, it will be apparent to one skilled in the art that various changes and modifications can be made therein without departing from the spirit and scope thereof.

What is claimed is:

1. A drafting film comprising a hydrophobic polyesterfilm support having formed thereon a matte layer comprising silicon dioxide as a matting agent and a mixture of (i) polymethylmethacrylate or a copolymer thereof having a molecular weight of about 10,000 to about 500,000 and (ii) nitrocellulose wherein the nitrocellulose is used in a mixing ratio of about 5 to 50% by weight based on total weight of the polymethyl methacrylate or a copolymer thereof and the nitrocellulose and the dry coverage of the above components is:

matting agent from 1 to 20 g/m$^2$, polymethyl methacryalte or a copolymer thereof from 1 to 10 g/m$^2$, and nitrocellulose from 0.5 to 10 g/m$^2$.

2. The drafting film as claimed in claim 1, wherein the copolymer of polymethyl methacrylate is a copolymer of methyl methacrylate and another vinyl compound.

3. The drafting film as claimed in claim 2, wherein the vinyl compound is methyl acrylate, ethyl acrylate, butyl acrylate, styrene, methylstyrene, chlorostyrene, vinyl acetate, vinyl chloride, vinylidene chloride, acrylic acid, acrylonitrile, glycidyl acrylate, glycidyl methacrylate, or hydroxyethyl acrylate.

4. A wash-off type photographic material comprising the drafting film of claim 1 as a support having formed thereon at least one silver halide photosensitive emulsion layer.

5. The wash-off type photographic film as claimed in claim 4, wherein the silver halide photographic emulsion layer or a layer adjacent to the silver halide emulsion layer contains a tanning developing agent.

6. The wash-off type photographic film as claimed in claim 4, wherein a layer containing carbon black is formed between the support and the silver halide photosensitive emulsion layer.

7. The drafting film as claimed in claim 1, wherein the molecular weight of the polymethyl methacrylate or a copolymer thereof is 100,000 to 300,000.

8. The drafting film of claim 7, wherein the mixing ratio of the nitrocellulose is about 10 to 40% by weight based on total weight of the polymethyl methacrylate or a copolymer thereof and the nitrocellulose.

9. The drafting film as claimed in claim 8, wherein the dry coverage of the component is:

matting agent from 3 to 10 g/m$^2$, polymethyl methacrylate or a copolymer thereof from 2 to B 5 g/m$^2$, and nitrocellulose from 1 to 5 g/m$^2$.

10. The drafting film as claimed in claim 9, wherein the particle size of the matting agent is 0.5 to 10$\mu$.

11. The drafting film as claimed in claim 10, wherein the particle size of the matting agent is 1 to 5$\mu$.

12. The drafting film as claimed in claim 1, wherein said support is polyethylene terephthalate.

* * * * *